US008757677B2

(12) United States Patent
Wintersteiger

(10) Patent No.: US 8,757,677 B2
(45) Date of Patent: Jun. 24, 2014

(54) LOCK WHICH CAN BE UNLOCKED IN AN ELECTRICALLY AUTOMATED MANNER, IN PARTICULAR FOR STORAGE SYSTEMS LIKE LOCKERS

(75) Inventor: Hans-Peter Wintersteiger, Hagenberg (AT)

(73) Assignee: KEBA AG, Linz (AT)

( * ) Notice: Subject to any disclaimer, the term of this patent is extended or adjusted under 35 U.S.C. 154(b) by 427 days.

(21) Appl. No.: 12/452,781

(22) PCT Filed: Jul. 25, 2008

(86) PCT No.: PCT/AT2008/000269

§ 371 (c)(1),
(2), (4) Date: Feb. 5, 2010

(87) PCT Pub. No.: WO2009/012512

PCT Pub. Date: Jan. 29, 2009

(65) Prior Publication Data

US 2010/0139338 A1 Jun. 10, 2010

(30) Foreign Application Priority Data

Jul. 25, 2007 (DE) ..... 10 2007 035 218

(51) Int. Cl.
*E05C 3/06* (2006.01)

(52) U.S. Cl.
USPC ..... 292/201

(58) Field of Classification Search
CPC ..... E05B 81/14; E05B 85/26; E05B 53/003; E05B 65/0014; E05B 53/00
USPC ..... 292/201, 216, 95, 96, 97, 98, DIG. 36, 292/195, 194, 196, 23, 251.5, 1, DIG. 23
See application file for complete search history.

(56) References Cited

U.S. PATENT DOCUMENTS 455,126 A * 6/1891 Smith et al. ..... 292/201
767,298 A * 8/1904 Louis ..... 292/201

(Continued)

FOREIGN PATENT DOCUMENTS

DE 92 09 053 9/1992
DE 42 28 233 3/1994

(Continued)

OTHER PUBLICATIONS

International Search Report, date completed 2008.

*Primary Examiner* — Kristina Fulton
*Assistant Examiner* — Nathan Cumar
(74) *Attorney, Agent, or Firm* — Collard & Roe, P.C.

(57) ABSTRACT

The invention relates to a lock (1) which can be released on an electrically automated basis, in particular for use with locker-type storage systems. A lock element (9) which can be introduced into the lock (1) is provided, which lock element (9) can be blocked in the lock (1) and thus holds a locker door (2) fixedly connected to the lock element (9) in the closed position. A lock pawl (14) which can be displaced in rotation to a limited degree is also provided, which engages with the lock element (9), either directly or indirectly via at least one displaceably mounted coupling element (12). The key feature of this is that the portion of a point of force transmission (33') for the locking force transmitted to the lock pawl (14) is designed so that a positively-induced and abutment-induced transmission of forces and pulses from the lock element (9) or from a coupling element (12) optionally mounted in between to the lock pawl (14) is directed almost exclusively radially to its pivot axis (31) and any tangential force or impulse components which occur can be transmitted almost exclusively due to frictional forces at the point of force transmission (33'). This results in increased protection again the effects of tampering from outside.

27 Claims, 3 Drawing Sheets

(56) References Cited

U.S. PATENT DOCUMENTS

| | | | | | |
|---|---|---|---|---|---|
| 971,423 | A | * | 9/1910 | Walters | 292/201 |
| 1,155,953 | A | * | 10/1915 | Morrow | 292/130 |
| 1,199,199 | A | * | 9/1916 | Mason | 292/201 |
| 2,034,971 | A | * | 3/1936 | Brockway | 292/340 |
| 2,081,055 | A | * | 5/1937 | Kiracofe | 292/201 |
| 2,815,085 | A | * | 12/1957 | Whipple | 180/289 |
| 3,312,492 | A | * | 4/1967 | Remhof | 292/201 |
| 3,325,203 | A | * | 6/1967 | Moler | 292/201 |
| 3,416,515 | A | * | 12/1968 | Mertler | 126/273 R |
| 3,566,703 | A | * | 3/1971 | VanNoord | 74/50 |
| 3,955,840 | A | * | 5/1976 | Rawls et al. | 292/229 |
| 4,030,322 | A | * | 6/1977 | Pettit | 70/159 |
| 4,056,276 | A | * | 11/1977 | Jarvis | 292/201 |
| 4,088,354 | A | * | 5/1978 | Kolendowicz | 292/201 |
| 4,111,473 | A | * | 9/1978 | Bourrie et al. | 292/126 |
| 4,470,625 | A | * | 9/1984 | Walsh et al. | 292/201 |
| 4,652,027 | A | * | 3/1987 | Quantz | 292/201 |
| 4,927,996 | A | * | 5/1990 | Genbauffe et al. | 219/413 |
| 5,004,276 | A | * | 4/1991 | Hanley | 292/126 |
| 5,029,910 | A | * | 7/1991 | Genbauffe et al. | 292/110 |
| D320,545 | S | * | 10/1991 | Sciarrino | D8/339 |
| 5,072,974 | A | * | 12/1991 | Henne | 292/126 |
| 5,492,382 | A | * | 2/1996 | McBride et al. | 292/341.17 |
| 6,027,148 | A | * | 2/2000 | Shoemaker | 292/216 |
| 6,089,626 | A | * | 7/2000 | Shoemaker | 292/216 |
| 6,099,048 | A | * | 8/2000 | Salmon et al. | 292/216 |
| 6,279,972 | B1 | * | 8/2001 | Brill et al. | 292/216 |
| 6,450,554 | B1 | * | 9/2002 | Rotondi et al. | 292/158 |
| 6,659,515 | B2 | * | 12/2003 | Raymond et al. | 292/201 |
| 6,953,232 | B2 | * | 10/2005 | Busby et al. | 312/332.1 |
| 7,210,712 | B2 | * | 5/2007 | Artsiely | 292/97 |
| 7,603,882 | B2 | * | 10/2009 | Carbajal et al. | 70/267 |
| 7,959,194 | B2 | * | 6/2011 | Mahoney | 292/99 |
| 8,047,582 | B1 | * | 11/2011 | Rodgers et al. | 292/201 |
| 2002/0096890 | A1 | | 7/2002 | Cetnar et al. | |
| 2002/0171250 | A1 | * | 11/2002 | Kobayashi et al. | 292/216 |

FOREIGN PATENT DOCUMENTS

| | | |
|---|---|---|
| DE | 202 16 873 | 3/2004 |
| DE | 601 07 208 | 10/2005 |
| EP | 0 589 158 | 3/1994 |
| EP | 1 257 722 | 11/2002 |

* cited by examiner

LOCK WHICH CAN BE UNLOCKED IN AN ELECTRICALLY AUTOMATED MANNER, IN PARTICULAR FOR STORAGE SYSTEMS LIKE LOCKERS

CROSS REFERENCE TO RELATED APPLICATIONS

This application is the National Stage of PCT/AT2008/000269 filed on Jul. 25, 2008, which claims priority under 35 U.S.C. §119 of German Application No. 10 2007 035 218.4 filed on Jul. 25, 2007. The international application under PCT article 21(2) was not published in English.

The invention relates to a lock which can be released on an electrically automated basis.

Document DE 92 09 053 U1 discloses an electrically releasable or unlockable lock which is primarily used for automated locker systems and similar. A rotating latch disposed in the lock housing for the lock catch fixedly attached to a door panel is biased by means of a spring in order to effect a rotating movement in the opening or releasing direction when the latch is released or unlocked. This disc-shaped latch has a cut-out respectively on two immediately adjacent circumferential portions, and the first cut-out is designed to engage with the lock catch and the second cut-out is designed to engage positively in a linearly displaceable bolt provided in the form of an armature of an electromagnet. When the armature of the electromagnet locates in the latch, the latch is blocked so that it is not able to rotate in either direction of rotation, as a result of which the door panel is held in its closed position by the lock catch. The armature of the electromagnet is biased by means of another spring so that it is constantly biased in the direction towards the latch and engages in its second cut-out when the latch is positioned so that the armature of the electromagnet is able to move into this cut-out. Also provided on this lock are reed contacts and magnets or similar switch elements to enable the closed state of the lock or door to be detected. This known lock is therefore designed so that when electromagnetically released by the electromagnet, the locker door simultaneously moves open by at least a gap because the lock catch of the door panel is forced outwards with respect to the locker interior by the spring-biased latch. This lock is described as being tamper-proof. However, with this construction, the force transmitted from the latch to the armature of the electromagnet is directed transversely to the actuating direction of the armature, which means that the electromagnet can be very easily damaged since it is not usually designed to withstand the strong armature transverse forces which would generally occur if an attempt were made to tamper with the door secured by this lock.

In the case of locks of a similar design known from the prior art, strong mechanical impulses transmitted to the door and then to the lock can lead to a relative shifting of the armature with respect to the latch so that the armature slips out of the latch, causing the latch to be released and the locker door to be opened. This undesired opening of the locker door may occur if the lock construction is subjected to a strong impact or a series of smaller impacts. If a lock of this type is fitted in an automatic locker system with a plurality of locker doors, a situation could even arise in which several lockers opened simultaneously if the machine construction were subjected to intensive pulses in the worst case scenario. This sensitivity to mechanical impulses and vibrations could theoretically be eliminated by opting for constructions that are retained by friction, for example by gear systems and/or motorised drives with brake devices. However, gears also represent a weak point in terms of breakage when subjected to strong impacts and have another disadvantage in that they require maintenance. Such constructions also incur higher costs and require more complex actuation systems.

Patent specification EP 0 589 158 B1 describes a remotely controllable lock, which is primarily used for doors of motor vehicles. This lock has a latch co-operating with a lock bolt, which blocks a lock pawl when in the locking position. The lock pawl is provided in the form of a pivotably mounted lever, which co-operates with the latch on the one hand and is operated by an electromagnetic actuator drive on the other hand in order to transfer the lock pawl into the inactive position so that the latch is released and the lock unlocked. This publication discloses a number of features intended to offer a simple design with few mechanical parts. Some of the described electrical or electro-mechanical features are used as a means of releasing the lock in emergency situations, especially if the electrical power supply for the lock is cut off. This publication does not describe any features designed to improve the ability of this lock to withstand manipulation, especially in connection with mechanical impulses and vibrations.

The underlying objective of this invention is to propose a lock which can be released on an automated basis for use in automated locker facilities, which offers a high degree of robustness and an ability to withstand breakage in spite of being of a simple and compact design, and in particular which offers increased safety in terms of tampering.

This objective is achieved on the basis of the features in accordance with the invention. These ensure that at the point where force is transmitted between the lock pawl and the lock element or a coupling element mounted in between, force and impulse components in the tangential direction with respect to the pivot axis of the lock pawl are not transmitted elastically and loss-free via a positive connection, for example in the manner of a step, shoulder or toothing, but are transferred with loss only, due to frictional forces. In conjunction with the inertia of the lock pawl, the intensity of the impulse transmitted to the lock pawl and hence also the degree of any resultant turning of the lock pawl due to such an impulse is significantly reduced. Force and impulses are transmitted friction-free and hence free of loss exclusively in the radial direction from the point where the force is introduced to the axis of rotation, where they are dispersed via the axis of rotation into the housing but without transmitting torque to the lock pawl. It is also expedient to ensure that no tangential force and impulse components are transmitted to the lock pawl loss-free if the lock pawl does not engage directly in the lock element but in a coupling element mounted in between, for example a latch, although it might seem at first view that no shifting in the tangential direction is actually possible due to the way the coupling element is mounted relative to the lock pawl. However, a slight mounting clearance which always exists will mean that a slight radial movement of the coupling element and latch is always possible and hence a tangential shift with respect to the lock pawl, which means that forces and impulses can be transmitted in this direction. Also of advantage is the fact that this lock is of a mechanically simple and compact design with only a few moving parts, whilst nevertheless being robust. The resultant lock also lends itself to a controlled and in particular electrical releasing action, which means that locker systems or storage systems of the locker type can be made to the simplest possible design. Of particular advantage is the fact that in spite of being based on a mechanical design that is relatively uncomplicated, the lock proposed by the invention offers a high degree of safety in terms of being tamper-proof. In particular, the lock proposed by the invention offers an improvement in terms of its ability to withstand attempts to open it, even if the lock or machine construction is subjected to strong impulses or vibrations. Above all, if the locker door or locker body and then the lock element is subjected to impacts, this does not lead directly to a transmission of turning impulses or turning forces to the lock pawl. In a surprisingly effective manner, any transmission of turning impulses or tangential forces from the lock element to the lock pawl is prevented as far as possible or is weakened to the degree that any unintended or undesired pivoting of the lock pawl can be virtually ruled out. The design of the lock proposed by the invention is extremely resistant to tampering if the lock element is biased in its opening direction by the locker door and mechanical impacts or vibrations are simultaneously introduced into the locker door or locker body. Fraudulent attempts at tampering can be more readily deterred and thwarted by the lock construction proposed by the invention, even though relatively simple driving elements are used, which enable inexpensive and structurally simple automation as well as electrical actuation of the lock based on relatively low power consumption.

A design defined in an embodiment is also of advantage because it offers even better protection against tampering due to the fact that the lock pawl essential for the locking action is less easy to reach and modify from outside, regardless of what tools are used, because the lock pawl is better protected against access due to the coupling element mounted in between and the fact that it is disposed behind the latch. Furthermore, by using different lever lengths for the latch relative to its pivot axis, a first increase takes place from the opening force transmitted by the lock element to the force transmitted to the lock pawl, which means that during the unlocking process by an electrical drive element, in particular an electromagnet, the frictional force which has to be overcome on the contact surface is reduced. The coupling element and latch may also be biased in the opening direction by means of a spring, thereby offering an easy means of providing an opening force for a locker door which can be released on an automated basis. Another essential aspect is that, due to the way the coupling element and latch are mounted, the possible degree by which they can be pivoted outwards compared with the possible direct outward pivoting movement of the lock element is limited to the amount of the relatively small mounting clearance of the latch, which means that the point at which force is introduced into the lock pawl is set accordingly to provide a reliable pre-definable physical release.

Another embodiment makes for a particularly inexpensive lock design and a high degree of anti-tampering protection can be obtained with few components. The tensile forces acting on the lock pawl can be absorbed by its rotary bearing without any problem.

The features defined in another embodiment are also of particular advantage because they offer a structurally simple but efficient way of preventing the side of the lock pawl from lying against the lock element or coupling element so that forces running at a tangent to its pivot radius or displacement path are transmitted positively and without loss. In particular, the lock pawl is particularly reliable in terms of remaining in its locking position when the lock element is biased in the opening direction of the locker door and the lock construction is simultaneously being subjected to strong impulses or mechanical vibrations, especially the lock element mounted on the door side.

Another embodiment is of particular advantage because it results in a defined locking position for the lock pawl, in which the lock pawl generates an optimum locking action. At the same time, the positive uncoupling is maintained between the lock element or coupling element and the lock pawl with regard to directions at a tangent to the rotatable lock pawl.

Due to the advantageous features defined in another embodiment, the undesirable transmission of angular accelerations and rotational impulses to the lock pawl can be prevented if the lock as a whole is accelerated. Also achieved as a result of this embodiment is the fact that if the lock mechanism is subjected to acceleration due to impact, for example due to impacts with a heavy hammer or such like, the forces largely act via the point of the rotary bearing of the lock pawl and are not transmitted to the lock pawl via a lateral bearing point of the lock pawl on the lock element or coupling element. This prevents a rotational impulse from being transmitted to the lock pawl in a particularly efficient manner.

Another embodiment enables the use of drive elements which generate only relatively low driving forces, which means that drives can be used which are as far as possible mechanically simple, inexpensive and operate with low energy consumption. In addition, due to the relatively low driving power needed, the amount of heat generated inside the lock remains very low. Another particular advantage of using an electromagnet is the compactness of this driving element.

As a result of the features defined in another embodiment, a relatively inexpensive, linearly displaceable drive may be used, which is mechanically simple and can be reliably coupled with the rotatable lock pawl for a long service life. The coupling element is specifically provided in the form of the articulating, interconnected coupling rod, which enables the linear movement of the connecting rod magnet to be adapted to the rotatably mounted lock pawl. Another particular advantage of this construction resides in the fact that lateral pressure on the armature and its slide bearing is as good as totally prevented. Even smaller variances due to component or fitting tolerances can be compensated without problem as a result. This ensures that the armature of the electromagnet remains readily displaceable, does not jam and the full driving and resetting force is transmitted to the lock pawl.

Another embodiment is of particular advantage. The coupling of the electromagnet with the lock pawl is not only articulated but also longitudinally adjustable to a limited degree, which enables an acceleration to be transmitted to the armature for a short, defined initial distance in the first instant of activation of the electromagnet without any effective opposing force from the lock pawl. It is not until the defined initial path has been travelled that the coupled displacement takes effect so that the lock pawl follows the remaining movement of the armature. Once the coupled displacement is established, it is not just the magnetic pulling force of the armature which is active but also the mechanical impulse of the already accelerated armature, so that this impulse can be used in addition to overcome the static friction and to release the lock pawl from its locking position.

Due to further embodiments, positive obstructions of the lock pawl in the direction of its releasing position by the coupling element are prevented. As a result, when the coupling element is turned or in the case of a permanent resilient biasing action of the coupling element, provided in the form of a latch in particular, no strain or jamming occurs with respect to the pawl. Furthermore, the lock pawl is guaranteed to be transferred into the releasing position in a controlled manner as intended, even with relatively low driving power or relatively low driving forces.

As a result of another embodiment, the lock pawl can be released or moved away from the coupling element easily, in particular from the latch, when the drive element is activated. An automated, controlled or intended releasing action of the lock can therefore be reliably guaranteed. In particular, this prevents strain and jamming between the coupling element and lock pawl, resulting in reliable releasing of the lock as soon as the drive element for the lock pawl has been activated accordingly.

In a particularly advantageous embodiment, the locking force is not transmitted from the lock pawl to the coupling element or lock element via a direct contact surface of the lock pawl but via a rotatably mounted rotary body connected to the lock pawl or coupling element or alternatively to the lock element. As a result of the rotary body, which acts in the manner of a force-transmitting gear, the tangential component of forces and impulses which can be transmitted to the lock pawl are quite significantly reduced if impulses are transmitted via the abutment or in the event of relative movements with respect to the abutment. As a result, this reduces the risk of forced, unauthorized unlocking of the lock and hence unauthorized opening of a locker door due to impacts and vibrations, but above all means that the forces which need to be applied by the drive element in order to transfer the lock pawl from the locking position into the releasing position are also reduced. The drive element provided as a means of effecting the release may therefore be designed to be less powerful than otherwise and hence more compact and inexpensive. In particular, if a relatively high tensile or pushing force is acting on the lock element, for example because a biasing force is acting on the internal face of the locker door due to the fact that articles have been stored incorrectly or carelessly, the lock can be electrically released in a controlled manner by relatively low-power drives.

The features defined in another embodiment ensure that the force positively transmitted to the lock pawl via the force-transmitting point is oriented in the direction towards the pivot axis of the lock pawl, as a result of which no torque is generated about the pivot axis.

Another embodiment ensures that the drive element, in particular the electromagnet and the slide bearing for its armature, does not apply blocking forces and is uncoupled in this respect. Instead, the requisite locking or blocking forces are absorbed and provided solely by the rotary bearing for the lock pawl and are so in a defined and mechanically reliable manner.

An embodiment is of particular advantage.

It provides a simple and effective way of ensuring that if an impulse is transmitted to the housing of the lock and then via the pivot axis to the lock pawl, the lock pawl provided in the form of a lever does not turn because the force is transmitted at its center of gravity. This prevents torques from being generated on one side of the lever if its axis of rotation is accelerated in the direction perpendicular to the lock pawl longitudinal axis or in the direction perpendicular to the lever longitudinal axis.

The lock pawl, which remains neutral and unaffected by the effects of external vibrations as far as possible, can be further improved as a result of the features defined in another embodiment. In particular, the lock pawl remains as far as possible in its locking position and is subjected to the slightest torque possible if the lock is subjected to forceful impacts or strong deflections.

As a result of the features defined in another embodiment, the lock pawl is biased via the spring means so that it automatically locates round the lock element or latches in the coupling element as soon as the lock element has moved sufficiently far into the lock housing as the door is being closed or as soon as the coupling element has been moved into the predefined closed position by the lock element. In particular, this obviates the need for electrical actuation of the lock in order to lock a locker door once it has closed. Another advantage of this is that the return spring for the armature of the electromagnet is also used as a means of automatically locking the lock once the locker door has been pulled to, thereby keeping the number of components needed for the lock to a minimum and keeping electrical actuation of the lock as simple as possible.

As a result of the features defined in another embodiment, a robust lock mechanism is obtained given the size of the lock pawl because the lock pawl is not subjected to strain due to bending. The rotary bearing is also particularly suitable for absorbing high mechanical forces. Moreover, a rotary bearing continues to function very reliably, even after numerous motion cycles of the lock pawl.

Due to the features defined in another embodiment, rotary impulses transmitted by the restrictor stop to the lock pawl are minimized and kept negligibly low. Especially if the restrictor stop is disposed close to one of the end portions of the rotatably mounted lock pawl, a relative displacement of the lock pawl relative to the restrictor stop is kept as small as possible when vibrations are acting on the lock housing.

The transmission of impulses between the restrictor stop and the lock pawl is also reliably prevented by the features defined in another embodiment.

The features defined in another embodiment prevent any impulse-type tangential or rotational forces from being transmitted from the lock element or coupling element to the lock pawl. In particular, on assuming its locking position, the rotatable lock pawl is not supported on the lock element or on the coupling element in the direction at a tangent to its pivot axis. Instead, the lock pawl is supported in a load-transmitting arrangement inside the lock by means of the separately designed, independent restrictor stop. This restrictor stop can be positioned with a high degree of precision and good reproducibility so that only forces extending radially with respect to its pivot axis act on the lock pawl when the locker door and hence the lock element is pushed in the opening direction. The restrictor stop offers another advantage over the lock pawl in that the lock pawl assumes the optimum locking position in which the best security is obtained in terms of locking and preventing tampering, even when the lock has undergone a number of operating cycles. In particular, a design of this type is susceptible to little wear or abrasion, even in the long term.

As a result of another embodiment, the restrictor stop is moved relatively far away from the lock element or coupling element, i.e. from the source of potential vibrations caused by mechanical impacts, as a result of which the vibrations or relative movements acting on the restrictor stop and subsequently on the lock pawl can be kept as low as possible.

The features defined in another embodiment provide an effective way of keeping a transmission of impulses or forces between the restrictor stop and the lock pawl to a particularly low level.

The advantage of the another embodiment is that it obviates the need for providing or fitting the restrictor element on the lock housing separately, thereby simplifying the design and further reducing the cost of manufacturing the lock housing.

As a result of the features defined in another embodiment, attempts to manipulate the lock or a locker as well as malfunctions can be easily detected. In particular, a system is provided which reliably detects whether the locking or closing bolt has been moved sufficiently far into the lock housing and whether the lock pawl has assumed its locking position. It is therefore possible to detect, on an automated basis, any locker doors which have not been fully closed or correctly locked, and appropriate steps can be initiated by the control system or the user can be alerted to the fact.

As a result of the features defined in another embodiment, positive use can be made of a lever transmission ratio of the latch if the lever length of the latch between the engagement for the lock element and the axis of rotation of the latch relative to the lever length between the axis of rotation and the contact point with the lock pawl is selected so that the contact force between the latch and the lock pawl is reduced, as a result of which the force needed by the electromagnet to overcome the static friction on the support surfaces between the latch and the lock pawl is reduced. This means that an electromagnet which generates relatively low positioning forces will be sufficient for the intended purpose. Such drive elements are inexpensive, lend themselves to a compact design, require low energy consumption and generate a particularly low amount of heat.

As a result of further embodiments, the relative position between the locker door and the lock housing is limited in a reliable and stable manner. In particular, the lock element on the locker door is prevented from being moved inadmissibly far into the housing if the locker door is being subjected to untypically strong forces due to tampering or vandalism.

Finally, the feature defined in another embodiment is of advantage because it prevents the lock element from being disengaged from the lock pawl or coupling element in the event of vandalism or attempts to force closed locker doors open. Unauthorized opening of a locker is therefore even more reliably prevented.

As a result of the features defined in another embodiment, the lock pawl is mounted so that it moves easily and can be reliably turned out of or into the locking position by the drive element or by the spring means. This is particularly important, given that the lock proposed by the invention must function reliably without maintenance for a long period and within a broad temperature range. The use of viscous lubricants to reduce friction on the bearings is not desirable for reasons pertaining to dirt, maintenance and the broad temperature range to which the lock is exposed during application. Another advantage of using a bearing bush made from plastic is that the lock pawl is electrically isolated from its bearing bolt, thereby ensuring that no electro-corrosion can occur at the bearing point in the long term, even in a damp environment, which could otherwise lead to an increase in friction in the bearing or even seizure of the bearing.

The easy movement of the lock pawl is also improved as a result of the feature defined in another embodiment. Due to the fact that the transition between the lock pawl and the latch or lock element at the point where force is introduced is not electrically conductive, no electro-corrosion can occur at the contact point and any increase in bearing friction is prevented. If the non-conductive material is selected accordingly, a particularly low coefficient of friction can be obtained which is largely unaffected by ambient conditions. This further improves the reliability of the lock.

The invention will be explained in more detail below with reference to examples of embodiments illustrated in the appended drawings.

Of these:

Figure 1:
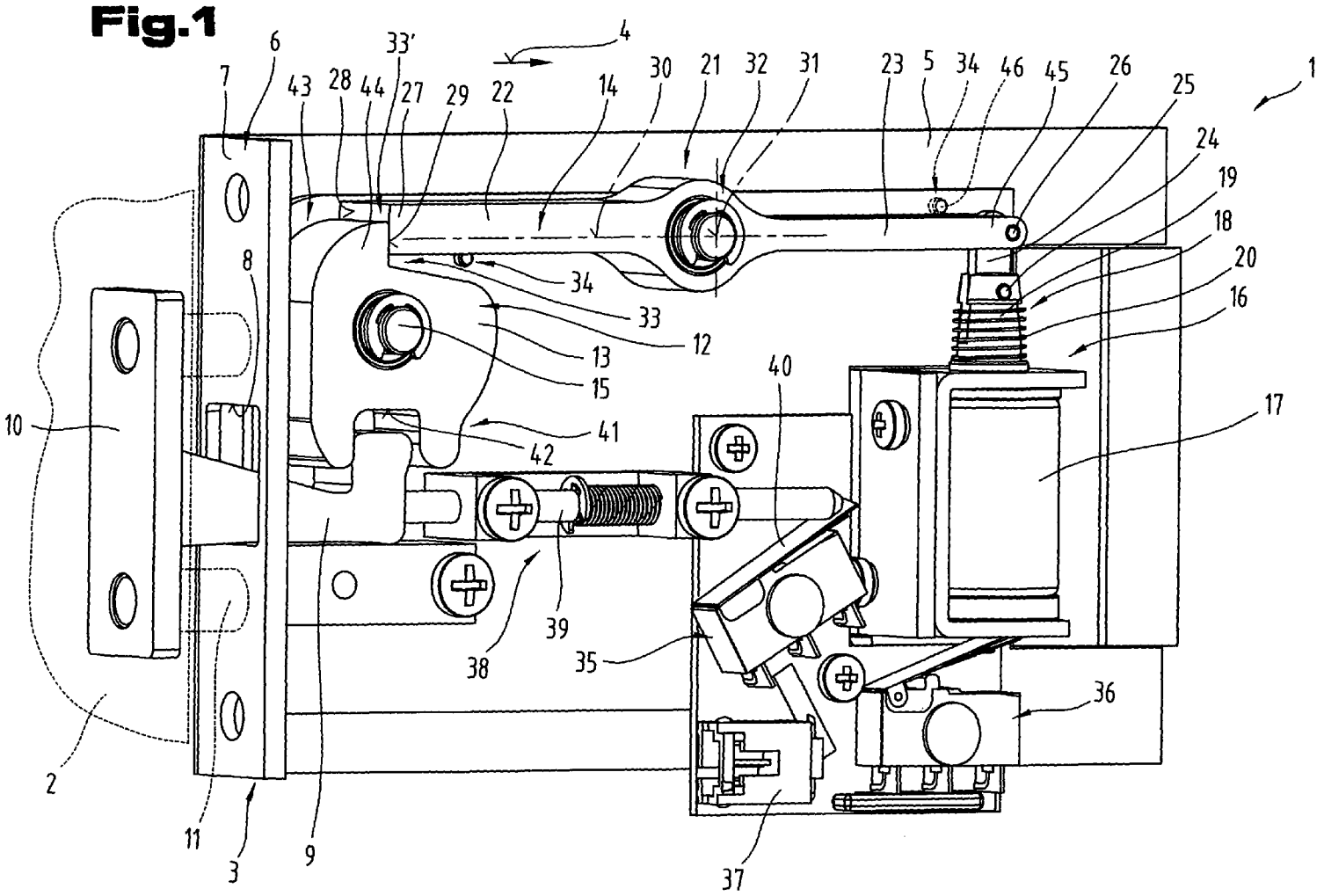
FIG. 1 is a diagram illustrating a perspective view of a first embodiment of a lock which can be released on an electrically automated basis and offers a greater degree of protection against manipulation.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
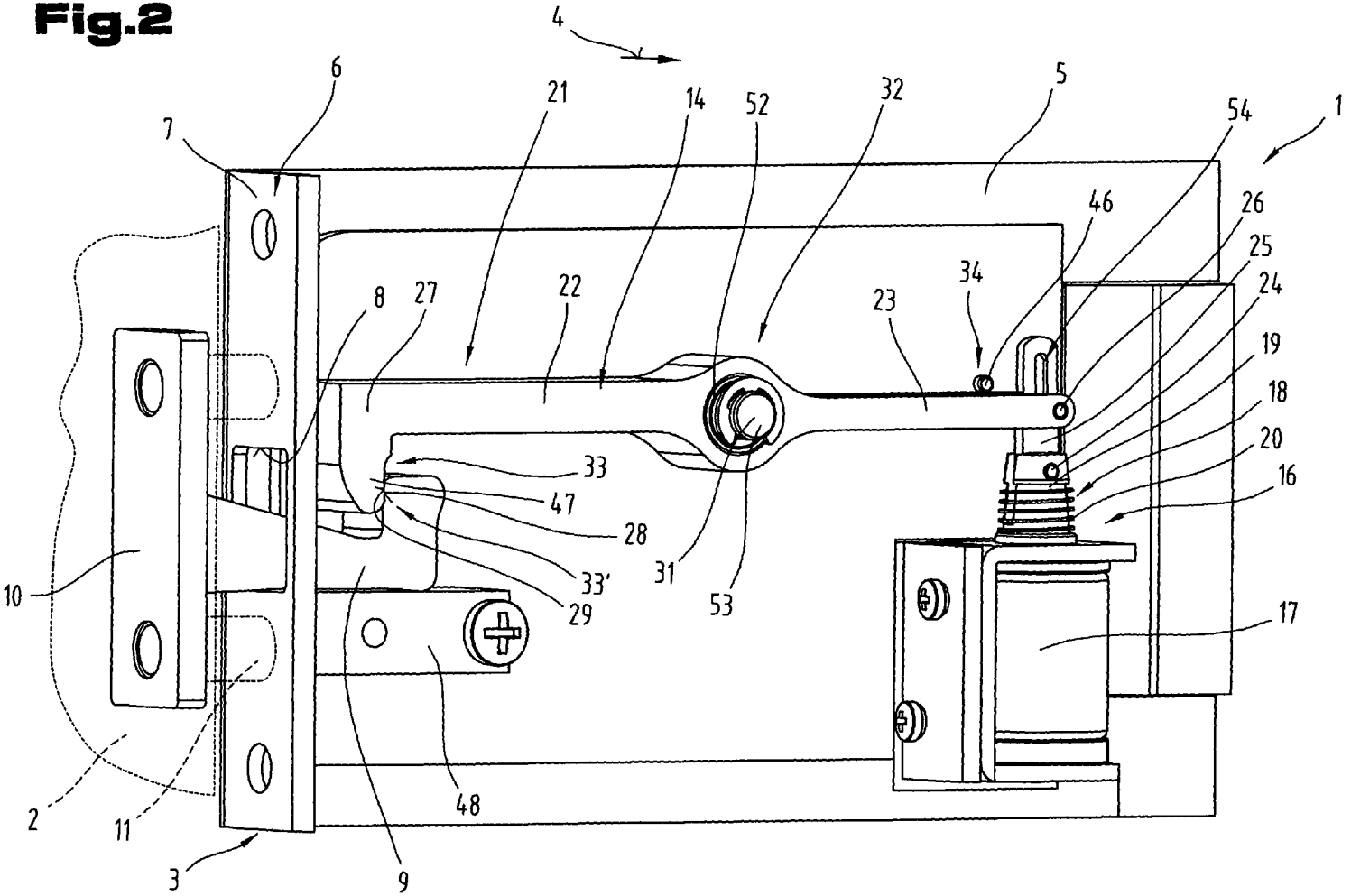
FIG. 2 illustrates another variant of the lock which can be released on an automated basis without a coupling element between the lock element and lock pawl.

FIGS. 1 and 2 each show perspective views of a lock 1 proposed by the invention with the front part or cover part removed. This lock 1 is primarily used for automated storage lockers, in particular for locker systems or so-called parcel depots, designed for use by people in general or for specifically registered users. In particular, a schematically indicated locker door 2 for a locker compartment within a locker arrangement of the automated storage system can be released by means of this lock 1 at least on an automated basis. To this end, the lock 1 proposed by the invention is connected to an electrical control system, which is able to effect an automated or remotely controlled release of the lock 1 if access to the relevant locker previously closed by the locker door 2 has been authorised.

The lock 1 has a rectangular-shaped lock housing 3 that is as strong as possible, and the mechanical and electrical components of the lock 1 are accommodated in the interior of the solid and robust lock housing 3. A longitudinal extension of the lock housing 3 extends parallel with the depth direction—arrow 4—of a locker, access to which is controlled by the lock 1 in conjunction with the locker door 2. The lock housing 3 comprises a plate-type base part 5 and a cover-type front or top part, although this is not illustrated, between which the interior for accommodating the electromechanical lock components is defined. The base part 5 preferably has an angled portion 6, which constitutes a side wall plate 7 of the lock housing 3. An orifice 8 is provided in this side wall plate 7, which permits access for a lock element 9 or a co-operating bolt in order to the lock housing 3. This lock element 9, which might be hook-shaped, bow-shaped or incorporate an eye for example, or may alternatively be provided in the form of a bolt with undercuts or wider areas in its cross-section, is preferably connected as rigidly as possible and so that it is susceptible to as little wear as possible, via a mounting plate 10 to a co-operating locker door 2, and in particular is screwed to it. In a preferred embodiment, when the locker door 2 is in the closed and locked state, this mounting plate 10 for the bolt or lock element 9 is supported in a load-transmitting arrangement on the lock housing 3, in particular its side wall plate 7, with at least one spacing and screw fixing means 11 for the mounting plate 10 on the locker door 2 connected in between. These spacing and screw fixing means 11 are preferably based on a block-type design and may be provided in the form of a cylindrical body, for example, which affords a mutual support between the locker door 2 or between the mounting plate 10 for the lock element 9 and the lock housing 3. Amongst other things, this prevents the lock element 9 from being able to move too far into the lock housing 3 in the event of impact or pressure on the locker door 2, as a result of which damage to the lock mechanism or lock electronics can be easily prevented.

The described lock mechanism is particularly simple yet at the same time well protected against tampering. In the case of the embodiment illustrated in FIG. 1, a coupling element 12 is mounted in the lock housing 3, preferably in the form of a so-called latch 13, for establishing and releasing a mechanical coupling between the bolt or lock element 9 and a lock pawl 14. This coupling element 12 for positively retaining the lock element 9 or a co-operating retaining or locking bolt is blocked by the pivotably mounted lock pawl 14 to prevent any movement into its releasing position—not illustrated—on assuming its locked position for the locker door 2—as schematically indicated in FIG. 1. When the coupling element 12 is in the releasing position, the lock element 9 and the coupling element 12 are disengaged so that the lock element 9 is released from the lock housing 3 and the locker door 2 can be opened.

The coupling element 12, preferably provided in the form of a latch 13, is mounted so that it can pivot about an axis 15 extending transversely to the direction in which the lock element 9 is introduced into the lock housing 3. The pivoting movement of the latch 13 about the axis 15 is regulated by the lock pawl 14, in particular released or blocked. When the lock is in the locked position illustrated in FIG. 1, the lock pawl 14 blocks any rotating movement of the latch 13 in the opening and releasing direction and the latch 13 therefore holds the lock element 9 engaging in it firmly inside the lock housing 3. On assuming the releasing position due to the lock pawl 14, the latch 13 pivots or can be pivoted in the opening direction so that the lock element 9 can be extracted from the lock housing 3 as needed in order to open the locker door 2.

The latch 13 is preferably biased in the opening direction by a spring means, not illustrated, in a manner known per se so that the latch 13 is pushed into the releasing or opening position when the lock pawl 14 is in the inactive position, as a result of which the locker door 2 springs open by at least a gap due to the lock element 9 positively engaging in it.

The lock pawl 14 is coupled with a drive element 16 in displacement, preferably with an electromagnet 17 in the form of a connecting rod magnet. In particular, the position of the lock pawl 14 can be transferred in a controlled manner by the drive element 16 on an automated basis into a releasing or inactive position in which the latch 13 is able to turn in the direction of its releasing position. The drive element 16 or coupled displacement between the drive element 16 and lock pawl 14 is such that when the drive element 16 is without power or receiving no current, the lock pawl 14 is in its locking position illustrated in FIG. 1 or the lock pawl 14 is pushed into its locking position. A spring means 18 is preferably provided, which constantly or continuously pushes the lock pawl 14 into its locking position or blocking position. This spring means 18 may co-operate directly with the lock pawl 14. By preference, however, the spring means 18 co-operates with the drive element 16 in order to transfer the lock pawl 14 into the locking position automatically. In particular, the spring means 18, which is preferably a helical spring 20, co-operates with the linearly displaceable armature 19 of the electromagnet 17, provided in the form of a connecting rod magnet. The lock pawl 14 is constantly pushed into the locking position, being spring-biased by the spring means 18, which preferably surrounds the armature 19 of the electromagnet 17 and simultaneously constitutes the return spring for the armature 19 of the electromagnet 17.

The lock pawl 14 is preferably a two-arm lever 21, the first lever arm 22 of which serves as the lock pawl 14 and co-operates with the coupling element 12. The second lever arm 23 of the lever 21, which is preferably of a straight design, i.e. not curved, is coupled in displacement with the drive element 16, which can preferably be electrically activated. In particular, the linearly displaceable armature 19 of the electromagnet 17 is connected via a first articulated link 24 to a first end portion of a coupling rod 25 so that it can not be pulled. Another end portion of this coupling rod 25 spaced at a distance apart from the first end portion is connected via another articulated link 26 to the lock pawl 14, in particular its second lever arm 23. In particular, a coupled displacement is established between the linearly displaceable armature 19 of the electromagnet 17 and the rotatably mounted lock pawl 14 via a coupling element in the form of a coupling rod 25 with articulated joints at its end portions.

As clearly illustrated in FIG. 1, the end face 27 of the lock pawl 14 facing the coupling element 12, in particular the latch 13, sits in abutment with the coupling element 12 when the lock 1 is in the locked state illustrated. In particular, a support surface 28 is provided on the terminal end 27 of the lock pawl 14, which is a straight, rotatably mounted bar, which sits in abutment with an abutment surface 29 of the coupling element 12 when the lock pawl 14 is in its illustrated locking position. The abutment surface 29 on the coupling element 12 is oriented at a right angle or almost at a right angle to the longitudinal axis 30 of the lock pawl 14 when the lock pawl 14 assumes the locking position. However, the terminal end 27 of the lock pawl 14 facing the coupling element 12 may also have a partially cylindrical, in particular slightly cambered, support surface 28. This partially cylindrical support surface 28 thus forms linear support zones extending in the axial direction of the cylinder part-surface with respect to the abutment surface 29 on the coupling element 12 when the lock pawl 14 is in its locking position. A centre or rotation point of the partially cylindrical or cambered support surface 28 on the terminal end 27 thus extends at least more or less through the pivot axis 31 of a rotary bearing 32 for the lock pawl 14 or the centre or rotation point of the support surface 28 lies on the pivot axis 31 of the lock pawl 14. In order to reduce the coefficient of friction when the lock pawl 14 is pivoted and in order to prevent the occurrence of electro-corrosion at the point where force is transmitted, the support surface 28 may be coated with an electrically non-conductive coating or an electrically non-conductive insert or cover may be provided so that there is no direct electrical contact between the lock pawl 14 and the coupling element 12 and only a mechanical force transmission is possible. The non-conductive coating is preferably made from an electrically non-conductive plastic, which also reduces the coefficient of friction between the support surface 28 and the abutment surface 29, thereby reducing the force of the drive element 16 needed for the releasing action.

The blocking or locking force applied by the lock pawl 14 to the coupling element 12 preferably extends transversely and in a direct line through the pivot axis 31 of the rotary bearing 32 for the lock pawl 14, as may clearly be seen in the diagram of FIG. 1. In particular, the first lever arm 22 of the lock pawl 14, which extends in as straight a line as possible, is sheared along its longitudinal axis 30 by the coupling element 12 when an attempt is made to push the coupling element 12 into the opening position to enable the locker door 2 to be opened when the lock pawl 14 is activated or in the blocking state. This shearing force applied to the lock pawl 14 by the coupling element 12 is therefore directed directly through the centre of the rotary bearing 32 so that the lock pawl 14 is as far as possible not subjected to stress due to bending or is so to only the smallest possible degree, and instead is primarily subjected to shearing stress. The resultant forces can therefore be reliably absorbed by the rotary bearing 32, in particular by the pivot axis 31 for the rotatably mounted lock pawl 14, with relatively few problems.

In order to ensure that the lock 1 is protected as far as possible against tampering, it is essential that the portion of a point of force transmission 33' for the locking force transmitted to the lock pawl 14 is designed so that no tangential forces or tangential impulse components by reference to the pivot axis 31 of the lock pawl 14 are transferred from the lock element 9 or from the coupling element 12, if one is mounted in between as is the case with the embodiment illustrated as an example in FIG. 1, to the lock pawl 14 when it is in the locking position. As a result of the design proposed by the invention, forces or impulses are transmitted to the lock pawl 14 positively or due to an abutment as far as possible only in the direction extending radially with respect to its pivot axis 31.

To this end, it is of practical advantage if the locking or translating forces applied by the coupling element 12 to the lock pawl 14 act as far as possible at a right angle to the support surface 28 of the lock pawl 14 and the lock pawl 14 disperses these forces exactly in the radial direction towards the pivot axis 31 of the rotary bearing. In particular, this ensures that no actuation forces from the lock element 9 or from the coupling element 12 mounted in between oriented at a tangent to the pivot path of the lock pawl 14 can act on the lock pawl 14.

It is also of practical advantage if the lock pawl 14, in particular its terminal end 27, is not limited or blocked in its ability to move by the coupling element 12 directly—FIG. 1—or by the lock element 9—FIG. 2. In particular, when the coupling element 12 assumes the locking position—illustrated in FIG. 1—a physical or structural clearance 33 is left free between the lock pawl 14 and the coupling element 12. This clearance 33 is such that a passive pivoting movement of the lock pawl 14 or also an active pivoting movement of the lock pawl 14 in both pivoting directions is not prevented by the coupling element 12—illustrated in FIG. 1—or by the lock element 9—FIG. 2—i.e. both in the direction of its releasing position and in the direction of its locking position. This means that the lock pawl 14, in particular its terminal end 27 or terminal portion, does not lie on the latch 13 or coupling element 12. In particular, in the case of the embodiment illustrated in FIG. 1, there is no load-transmitting support between the lock pawl 14 and the latch 13 in the radial direction with respect to the axis 15 of the latch 13. A load-transmitting support between the latch 13 and the terminal end 27 of the lock pawl 14 exists exclusively in the direction of rotation or pivoting movement of the latch 13 by reference to its axis 15—and namely with respect to a torque of the latch 13 in its releasing or opening direction blocked by the lock pawl 14.

Instead, a restrictor stop 34 is provided separately from or independently of the coupling element 12—FIG. 1—or lock element 9—FIG. 2—in the form of a separate part, in order to restrict the ability of the lock pawl 14 to pivot relative to the coupling element 12—FIG. 1—or relative to the lock element—FIG. 2. When the lock pawl 14 assumes the locking position—as illustrated in FIGS. 1 and 2—the lock pawl 14 lies on this restrictor stop 34 so that it transfers load or is supported. This prevents the lock pawl 14 from being inadvertently or undesirably moved into its unlocking or releasing position due to impulses or force being transmitted to the coupling element 12 or latch 13, which impulses might be transmitted via the lock housing 3 and/or the bolt or lock element 9. In particular, these features ensure that no adverse or detrimental impulses are transmitted from the latch 13 to the lock pawl 14 because the lock pawl 14 does not lie in a load-transmitting arrangement or supported on the latch 13 in the radial direction towards the latch 13 due to the clearance 33. Any torque which might be transmitted to the lock pawl 14 and would cause the lock pawl 14 to tend towards its releasing position if subjected to external forces or impulses are eliminated or avoided as a result. This being the case, vibrations or impulses generated under circumstances of malicious intent will not lead to undesired opening of a locked locker door 2.

The same applies to the embodiment illustrated in FIG. 2. Here too, if mechanical impulses or vibrations are transmitted to the lock element 9, the lock pawl 14 disposed in its locking position is prevented from being transferred to its upwardly pivoted releasing position because the point of force transmission 33' between the lock element 9 and the lock pawl 14 is designed so that the forces emitted by the lock element 9 in conjunction with the lock pawl 14 are dispersed in exactly the radial direction towards the pivot axis 31 and, as far as possible, no tangential or pivoting forces can be transmitted to the lock pawl 14.

In order to improve the mechanical uncoupling or uncoupling of force-induced impulses between the coupling element 12, in particular the latch 13, and the lock pawl 14, the restrictor stop 34 defining the blocking or locking position of the lock pawl 14 may also be of an elastically flexible or cushioning design, in particular impart damping. The same applies to the embodiment illustrated in FIG. 2.

It is of advantage if the lock pawl 14 sits at least approximately trim relative to the pivot axis 31 or about the pivot axis 31 as regards weight or forces with respect to its two lever arms 22, 23. In particular, this means that the lock pawl 14 is held in an approximately horizontal position if no additional forces are acting on one side of it from outside. The lock pawl 14 may also sit trim with respect to its pivot axis 31 so that the weight of the first lever arm 22 at least approximately corresponds to the weight of the second lever arm 23, including the weight of the armature 19 of the electromagnet 17 attached to it. In the case of the second lever arm 23, allowance may also optionally be made for the weight of the coupling element, in particular the coupling rod 25, between the armature 19 of the electromagnet 17 and the second lever arm 23.

With a view to ensuring that the lock 1 is tamper-proof to a high degree, it is also of practical advantage if the restrictor stop 34 for predefining or defining the locking position of the lock pawl 14 is positioned in such a way that it is disposed closer, relatively speaking, to a terminal end 27 or 45 of the lock pawl 14 remote from the pivot axis 31 than to the pivot axis 31 of the lock pawl 14. It is expedient to position the restrictor stop 34 so that it is spaced apart from the pivot axis 31 by a distance of more than 30% of the length of the first or second lever arm 22, 23. Improved and highly reliable operation can also be achieved if the restrictor stop 34 co-operates with the second lever arm 23 of the lock pawl 1 facing away from the coupling element 12, as indicated by broken lines in FIG. 1 and by the restrictor stop 34 indicated by solid lines in FIG. 2.

By preference, the lock 1 also has a first detection means 35 for detecting whether the lock element 9 or bolt has moved into the lock housing 3. It is also preferable to provide a second detection means 36 for detecting the respective position of the drive element 16, in particular for detecting the position of the armature 19 of the electromagnet 17. This being the case, this second detection means 36 is positioned on the side of the electromagnet 17 lying opposite the armature 19, in particular on the side of the electric coil of the electromagnet 17 lying opposite the armature 19. This second detection means 36 is provided as a means of detecting the active position of the drive element 16, in particular for detecting whether the armature 19 was attracted by the electromagnet 17 or not. Accordingly, an extension of the armature 19 extends through the coil arrangement and thus operates the second detection means 36.

The two detection means 35, 36 are preferably provided in the form of electric switch elements, in particular normally open and/or normally closed contacts. The respective detection signals or switching states of the two detection means 35, 36 can be transmitted via an electrical plug connection 37 on the lock housing 3 to a control and evaluation system, although this is not illustrated. Accordingly, a three-wire connection is run to the electronic control system in order to forward the respective switching states of the two detection means 35, 36, provided in the form of switches.

The first detection means 35, which detects whether the lock element 9 has been moved into the lock housing 3 so that it can be blocked or locked by the coupling element 12, can be activated or operated via a motion-transmitting element 38, in particular by means of a linearly displaceable, resiliently biased ram element 39. This ram element 39 extends between an insertion and retaining portion for the lock element 9 and an operating element 40 of the detection means 35, in particular in the displacement path of a switch lug of the first detection means 35. The linearly displaceable ram element 39 is oriented at an acute angle with respect to the operating element 40 and the ram element 39 and detection means 35 are positioned relative to one another so that the end of the ram element 39 is moved past the detection means 35 and the detection means 35 does not act as an end stop for the ram element 39 if the ram element 39 is pushed unexpectedly far into the lock housing 3 due to attempted manipulation.

As explained above, the coupling element 12 is preferably provided in the form of a latch 13, which is mounted so that it can pivot inside the lock housing 3 to a limited degree. Accordingly, in a first circumferential portion 41, the latch 13 has an indentation or cut-out 42 designed to positively engage with the lock element 9 or bolt. In another circumferential portion 43 of the latch 13, preferably lying diametrically opposite, a retaining lug 44 or indentation is provided for the abutment surface 29 constituting the lock pawl 14, which co-operates with the lock pawl 14.

Particularly effective protection against tampering is achieved if the restrictor stop 34 is designed as a damping element 46 for damping forces transmitted between the lock housing 3, in particular its plate-type base part 5, and the lock pawl 14. The restrictor stop 34 is mounted on or attached to the lock housing 3, in particular its base part 5. The damping element 46 may be provided in the form of a so-called spring pin or clamping pin or by an elastomeric body.

FIG. 2 illustrates a variant of the embodiment illustrated in FIG. 1. The description given above therefore applies literally to parts denoted by the same reference numbers. In this instance, the lock pawl 14 has a hook-shaped terminal end 27 or a hook end 47, by means of which the lock pawl 14 locates round the lock element 9, which is preferably a hook-shaped lock element 9 or incorporates an eye, on assuming the locking position—illustrated in FIG. 2. In particular, a direct coupling is established between the lock element 9 and the lock pawl 14, whereas in the case of the embodiment illustrated in FIG. 1, a coupling element 12 which can pivot to a limited degree is used. Otherwise, the explanations given above apply literally to FIG. 2.

What is achieved by the embodiments proposed by the invention is that the portion of the point of force transmission 33' for the locking force transmitted to the lock pawl 14 is designed so that forces and impulses induced by a positive fit and abutment transmitted from the lock element 9, or from a coupling element 12 which may optionally be mounted in between, to the lock pawl 14 are directed exclusively radially to its pivot axis 31 and any tangential force and impulse components which occur can be transmitted almost exclusively by frictional forces at the point of force transmission 33'.

In particular, the portion of the point of force transmission 33' for the locking force transmitted to the lock pawl 14 is designed so that as far as possible, no tangential forces or tangential impulse components by reference to the pivot axis 31 of the lock pawl 14 are transmitted from the lock element 9 or from a coupling element 12 which may be optionally mounted in between to the lock pawl 14 when it is in the locking position, but abutment-induced forces and impulses are transmitted to the lock pawl 14 in only the radial direction with respect to its pivot axis 31 as far as possible.

The rotary bearing 32 of the lock pawl 14 is provided in the form of the bearing bolt 53 fixedly connected to the base part 5 and a bearing bush 52 introduced into a bore of the lock pawl 14. The bearing bush 52 is preferably made from plastic to obtain a bearing which moves easily with a reliably low coefficient of friction, and this ease of movement is preserved for a long service life within broad temperature and load ranges. In particular, the electrically non-conductive bearing bush 52 also reliably prevents electro-corrosion at the bearing surface.

In another advantageous embodiment, a block-type or strip-type support 48 is provided along the insertion path of the lock element 9 provided in the form of a lock hook, on the side of the lock element 9 facing away from the lock pawl 14. By means of this support 48, which may serve as a guide mechanism for the lock element 9, the lock element 9 is better stopped or prevented from missing the lock pawl 14, especially when acted on by stronger forces due to manipulation with malicious intent or vandalism.

By preference, one of the articulated links 24 and 26 of the coupling rod 25 is designed so that the length can be varied in a defined manner to a limited degree due to the fact that the coupling rod has a slot 54 in which the shaft of the articulated link 26 is guided so that it can both rotate and move in translation to a limited degree. When the electromagnet 17 is activated, this permits acceleration and movement of the armature 19 only, but still without any movement and opposing force from the lock pawl 14. As soon as the armature 19 has travelled the minimum distance fixed by the slot 54, the lock pawl 14 follows the remaining movement of the armature 19. At the first instant of the coupled displacement, it is not just the attraction force of the electromagnet 17 to the lock pawl 14 which is effective but also an additional mechanical impulse due to the already accelerated mass of the armature 19. This means that the static friction between the support surface 28 and the abutment surface 29 at the point of force transmission 33' can be more reliably overcome. Due to a series of several electrical activation pulses for the electromagnet 17 and hence a series of mechanical impulses to the lock pawl 14, a lock which is seated stationary up to a certain degree can be hammered free. The operating reliability can be quite significantly increased as a result, especially if such hammering free is detected by the machine control system as being the onset of a defect and reported to a servicing point so that the requisite repair work can be organised even before an actual fault occurs in the form of a locker door that can not be automatically released.

The additional technical explanations given in connection with FIG. 2 also apply in the same way to the embodiment illustrated in FIG. 1.

Figure 3:
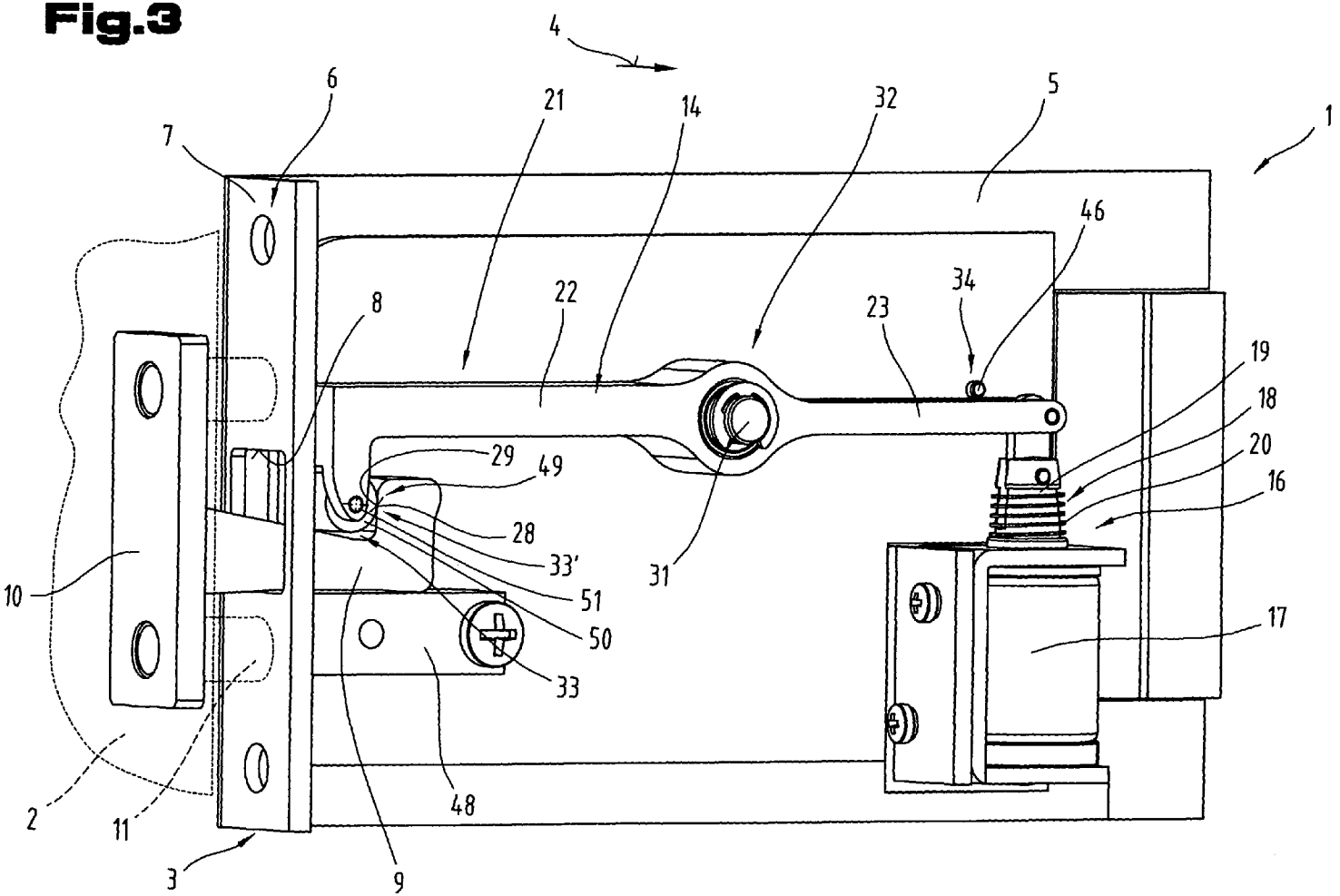
FIG. 3 is a schematic diagram illustrating an example of another variant of the lock with increased protection against manipulation.

FIG. 3 illustrates a different embodiment by means of which an adverse transmission of tangential forces via the point of force transmission 33' and beyond or by means of which the transmission of forces or rotational impulses acting at a tangent to the rotary bearing 32 or to the arcuate pivot path of the lock pawl 14 can be suppressed as far as possible.

This being the case, the end of the lock pawl 14 facing the lock element 9 or an all-purpose coupling element 12—FIG. 1—has a rotary body 49, in particular a rotatably mounted coupling roller 50, which is designed or disposed so that no forces or rotational impulses are transmitted to the lock pawl 14 from the lock element 9, or from a coupling element which may be optionally provided, in the direction extending at a tangent to the rotary bearing 32 as far as possible.

An axis of rotation 51 of this rotary body 49, mounted so that it can rotate freely, extends parallel with the pivot axis 31 of the lock pawl 14. This rotary body 49, which preferably rotates freely but may optionally be mounted so that it can rotate to a limited degree, minimises the forces or impulses which can be transmitted between the lock element 9 or a coupling element 12—FIG. 1—in the direction extending at a tangent to the pivot path of the lock pawl 14.

This rotary body 49 is preferably mounted on the hook end 47 or on the terminal end 27 of the lock pawl 14. Alternatively, it would naturally also be possible for the rotary body 49 to be mounted on the lock element 9, in particular to be mounted on a hook-shaped end of the lock element 9. It would likewise be possible for the rotary body 49 itself to constitute the hook end 47 of the lock element 9 or lock pawl 14. Another option is for the rotary body 49 to be mounted on a coupling element 12 which may be provided as an option—FIG. 1. In this respect, the rotary body 49 is preferably disposed in the second circumferential portion 43 co-operating with the lock pawl 14—see FIG. 1—in which case its external or rolling surface forms the abutment surface 29 for the lock pawl 14. Alternatively or in combination with this, it would also be conceivable for the rotary body 49 to be disposed in the first circumferential portion 41 co-operating with the lock element 9, in order to prevent or suppress impulses or forces from the lock element 9 acting radially with respect to the axis 15 of the coupling element 13.

Above all, it is essential that the rolling or external surface of the preferably cylindrical or wheel-shaped coupling roller 50 forms a mutually rolling support and abutment surface 28, 29 between the lock element 9 and/or a coupling element 12 which might be optionally provided and/or the lock pawl 14, and the rolling or external surface of the coupling roller 50 as far as possible prevents a quasi external torque or impulse, acting either directly or indirectly, from being transmitted to the lock pawl 14. However, the coupling roller 50 is designed so that it does transmit the locking or blocking force between the point of force transmission 33' and lock pawl 14, in particular between lock element 9 and lock pawl 14 directly or via a coupling element 12 mounted in between—FIG. 1. The coupling roller 50 may therefore also be described as a contact or force-transmitting wheel, which is of a sufficiently pressure-resistant design to transmit the respective locking or blocking forces needed between the lock pawl 14 and the lock element 9 without plastic deformation and without the risk of breaking.

FIGS. 1; 2; 3 illustrate various embodiments of a lock 1 proposed by the invention and it should be pointed out at this stage that the invention is not restricted to these embodiments.

Finally, for the sake of good order, it should be pointed out that in order to provide a clearer understanding of the structure of the lock 1, it and its constituent parts are illustrated to a certain extent out of scale and/or on an enlarged scale and/or on a reduced scale.

| List of reference numbers | |
|---|---|
| 1 | Lock |
| 2 | Locker door |
| 3 | Lock housing |
| 4 | Depth direction |
| 5 | Base part |
| 6 | Angled portion |
| 7 | Side wall plate |
| 8 | Orifice |
| 9 | Lock element |
| 10 | Mounting plate |
| 11 | Spacing and screw fixing means |
| 12 | Coupling element |
| 13 | Latch |
| 14 | Lock pawl |
| 15 | Axis |
| 16 | Drive element |
| 17 | Electromagnet |
| 18 | Spring means |
| 19 | Armature |
| 20 | Helical spring |
| 21 | Lever |
| 22 | Lever arm |
| 23 | Lever arm |
| 24 | Articulated link |
| 25 | Coupling rod |
| 26 | Articulated link |
| 27 | Terminal end |
| 28 | Support surface |
| 29 | Abutment surface |
| 30 | Longitudinal axis |
| 31 | Pivot axis |
| 32 | Rotary bearing |
| 33 | Clearance |
| 33' | Point of force transmission |
| 34 | Restrictor stop |
| 35 | Detection means |
| 36 | Detection means |
| 37 | Plug connection |
| 38 | Motion-transmitting element |
| 39 | Ram element |
| 40 | Operating element |
| 41 | Circumferential portion |
| 42 | Cut-out |
| 43 | Circumferential portion |
| 44 | Retaining lug |
| 45 | Terminal end |
| 46 | Damping element |
| 47 | Hook end |
| 48 | Support |
| 49 | Rotary body |
| 50 | Coupling roller |
| 51 | Axis of rotation |
| 52 | Bearing bush |
| 53 | Bearing bolt |
| 54 | Slot |

The invention claimed is:

1. An electrically automated releasable locking assembly providing enhanced resistance against tampering, the electrically automated releasable locking assembly comprising:

a lock housing;

a lock element fixedly connected to a locker door and introduceable into the lock housing;

a lock pawl disposed in the lock housing, comprising a linear member with a rotary bearing, and having a pivot axis, said lock pawl being rotably displaceable to a limited degree into a locking position, wherein the lock pawl either directly engages with the lock element or indirectly engages with the lock element via a displaceably mounted coupling element; and a drive element coupled with the lock pawl in displacement for moving the lock pawl in a controlled manner out of the locking position into a releasing position, the drive element comprising an electromagnet and a linearly displaceable armature having a first end and a second end, the linearly displaceable armature being connected at the second end to the electromagnet;

wherein forces transmitted from the lock element due to an opening force on the locker door held locked run directly or indirectly via the at least one coupling element at a point of force transmission to the lock pawl in a radial direction with respect to the pivot axis and are transmitted from the pivot axis to the lock housing;

wherein a section of the point of force transmission for the locking forces transmitted to the lock pawl is configured so that positively induced or abutment-induced forces and impulses transmitted directly or indirectly from the lock element to the lock pawl are directed radially with respect to the pivot axis and any occurring tangential force and impulse components are transmittable exclusively by frictional forces at the point of force transmission;

wherein the lock pawl is a two-arm lever comprising a first lever arm and a second lever arm, wherein the first lever arm cooperates with the lock element or the coupling element respectively, and the second lever arm is connected to the second end of the linearly displaceable armature of the drive element; and wherein the lock pawl sits with the first lever arm and the second lever arm balanced about its pivot axis, so that a weight of the first lever arm equals at least approximately a weight of the second lever arm plus a weight of the linearly displaceable armature.

2. The electrically automated releasable locking assembly as claimed in claim 1, wherein the lock pawl indirectly engages with the lock element via a displaceably mounted coupling element and the displaceably mounted coupling element comprises a latch, wherein the lock element positively engages in a first cut-out disposed circumferentially in the displaceably mounted coupling element in a closing position, wherein the displaceably mounted coupling element has an abutment surface on a circumference of the displaceably mounted coupling element for transmitting opening forces transmitted by the lock element when the lock pawl is in the locking position to the lock pawl, thereby blocking the lock element in the first cut-out.

3. The electrically automated releasable locking assembly as claimed in claim 1, wherein the lock pawl comprises a hook end for engaging directly in the lock element or locating around the lock element in the locking position, receives occurring opening forces, disperses the opening forces through the pivot axis and thus blocks the lock element in the lock housing.

4. The electrically automated releasable locking assembly as claimed in claim 1, wherein when the lock pawl assumes the locking position, a mutual physical clearance is left free between the lock pawl and the lock element or the coupling element so that a passive ability to pivot or an active pivoting movement of the lock pawl in a first pivot direction toward the releasing position and in a second pivot direction toward the locking position, is not restricted or is not prevented by the lock element or the coupling element.

5. The electrically automated releasable locking assembly as claimed in claim 1, wherein a restrictor stop which is structurally separate from the lock element or the coupling element is provided in order to restrict the lock pawl from pivoting relative to the lock element or the coupling element.

6. The electrically automated releasable locking assembly as claimed in claim 5, wherein the restrictor stop defining the locking position of the lock pawl is elastically flexible.

7. The electrically automated releasable locking assembly as claimed in claim 1, wherein the linearly displaceable armature is connected to the second arm of the lock pawl via a coupling rod having a first end portion and a second end portion, the first end portion of the coupling rod being connected to the linearly displaceable armature via a first articulated link, and the second end portion of the coupling rod being connected to the second arm of the lock pawl via a second articulated link so that a coupled displacement is established between the linearly displaceable armature of the electromagnet and the lock pawl.

8. The electrically automated releasable locking assembly as claimed in claim 1, wherein the linearly displaceable armature is connected to the lock pawl via an articulated link of variable length, so that when the electromagnet is activated, a coupled displacement is not established between the linearly displaceable armature and the lock pawl immediately as the linearly displaceable armature starts to move, and is not established until the linearly displaceable armature has traveled a defined minimum distance.

9. The electrically automated releasable locking assembly as claimed in claim 1, wherein the lock pawl indirectly engages with the lock element via a displaceably mounted coupling element and a terminal end of the lock pawl facing the displaceably mounted coupling element has a partially cylindrical support surface sitting in abutment with an abutment surface of the displaceably mounted coupling element when the lock pawl is in the locking position.

10. The electrically automated releasable locking assembly as claimed in claim 1, wherein the lock pawl indirectly engages with the lock element via a displaceably mounted coupling element and a terminal end of the lock pawl facing the displaceably mounted coupling element has a partially cylindrical support surface comprising linear support surfaces extending in an axial direction of the partially cylindrical support surface on a flat abutment surface on the displaceably mounted coupling element when the lock pawl is in the locking position.

11. The electrically automated releasable locking assembly as claimed in claim 1, wherein an end of the lock pawl facing the displaceably mounted coupling element or the lock element has a rotatably mounted coupling roller lying against an abutment surface of the displaceably mounted coupling element or on the lock pawl, when the lock pawl is in the locking position, and the rotatably mounted coupling roller transmits locking or blocking force between the point of force transmission and the lock pawl.

12. The electrically automated releasable locking assembly as claimed in claim 1, wherein an abutment surface for the lock pawl disposed on the lock element or the diplaceably mounted coupling element is oriented at a right angle or at least approximately at a right angle to an imaginary axis between the point of force transmission and the pivot axis of the lock pawl in the locking position.

13. The electrically automated releasable locking assembly as claimed in claim 1, wherein a blocking force applied by the lock pawl to the lock element or the displaceably mounted coupling element is absorbed or expended by the pivot axis of the rotary bearing for the lock pawl.

14. The electrically automated releasable locking assembly as claimed in claim 1, wherein the lock pawl is constantly forced into the locking position by a spring-biasing action of a spring for resetting the linearly displaceable armature of the electromagnet in a non-operating position.

15. The electrically automated releasable locking assembly as claimed in claim 2, wherein the first lever arm of the lock pawl extends in a straight line and is subjected to only shearing or tensile force by the displaceably mounted coupling element along a longitudinal axis, and the shearing or tensile force extends centrally through the rotary bearing for the lock pawl when an attempt is made to transfer the lock element into an opening position when the lock pawl is active.

16. The electrically automated releasable locking assembly as claimed in claim 5, wherein the restrictor stop is positioned to lie closer to a terminal end facing away from the pivot axis of the lock pawl than to the pivot axis of the lock pawl in order to define the locking position of the lock pawl in terms of position or pivot angle.

17. The electrically automated releasable locking assembly as claimed in claim 1, wherein a restrictor stop is positioned so that the restrictor stop is spaced apart from the pivot axis by a distance that is more than 30% of the length of the first or second lever arm.

18. The electrically automated releasable locking assembly as claimed in claim 5, wherein the restrictor stop is positioned so that the lock pawl lies against the restrictor stop on assuming the locking position.

19. The electrically automated releasable locking assembly as claimed in claim 1, wherein a restrictor stop co-operates with the second lever arm of the lock pawl facing away from the lock element or the displaceably mounted coupling element.

20. The electrically automated releasable locking assembly as claimed in claim 5, wherein the restrictor stop comprises a damping element for damping forces transmitted between the lock housing and the lock pawl.

21. The electrically automated releasable locking assembly as claimed in claim 5, wherein the restrictor stop co-operates with the drive element or is disposed in or on the drive element.

22. The electrically automated releasable locking assembly as claimed in claim 1, wherein a first detector is provided for detecting whether the bolt or the lock element has moved into the lock housing and a second detector is provided for detecting a position of the lock pawl.

23. The electrically automated releasable locking assembly as claimed in claim 2, wherein the displaceably mounted coupling element comprises a latch mounted so that the displaceably mounted coupling element can pivot to a limited degree, said latch having a cut-out or indentation in a first circumferential portion for engaging the lock element, wherein the lock element comprises a bolt or a lock hook, and, wherein the latch in a second circumferential portion comprises a retaining lug or indentation serving as an abutment surface for the lock pawl for co-operating with the lock pawl.

24. The electrically automated releasable locking assembly as claimed in claim 1, wherein the lock housing comprises a plate-shaped base part and a cover-shaped top part, and a mounting plate of the lock element is supported on the lock housing in a load-transmitting arrangement with an at least one spacing and screw fixing device for the mounting plate connected in between in a closed and locked state.

25. The electrically automated releasable locking assembly as claimed in claim 1, wherein a support is provided along an insertion path of the lock element or the displaceably mounted coupling element on a side facing away from the lock pawl for preventing the lock element or the displaceably mounted coupling element from slipping when acted on by increased force.

26. The electrically automated releasable locking assembly as claimed in claim 1, wherein the rotary bearing of the lock pawl comprises a bearing bush of plastic inserted in the lock pawl.

27. The electrically automated releasable locking assembly as claimed in claim 9, wherein at least one part constituting the partially cylindrical support surface or the abutment surface is made from or coated with an electrically non-conductive material in a region of the point of force transmission or has an insert made from the electrically non-conductive material.

* * * * *